United States Patent [19]

Hughes et al.

[11] 4,109,671

[45] Aug. 29, 1978

[54] SANITARY YARD HYDRANT

[75] Inventors: James L. Hughes; William E. Broerman, both of Cincinnati, Ohio

[73] Assignee: Industrial Value Analysis Inc., Cincinnati, Ohio

[21] Appl. No.: 682,497

[22] Filed: May 3, 1976

[51] Int. Cl.[2] ..... E03B 9/14

[52] U.S. Cl. ..... 137/282; 137/288; 137/519.5; 239/29; 251/267

[58] Field of Search ..... 137/272, 282, 286, 287, 137/288, 299, 301

[56] References Cited

U.S. PATENT DOCUMENTS

| | | | |
|---|---|---|---|
| 196,384 | 10/1877 | Porteous | 137/287 X |
| 3,017,896 | 1/1962 | Papacek | 137/282 |

*Primary Examiner*—Martin P. Schwadron
*Assistant Examiner*—Richard Gerard
*Attorney, Agent, or Firm*—Wood, Herron & Evans

[57] ABSTRACT

A nonfreezing, nonpolluting hydrant construction. The hydrant includes an above-ground discharge head, a main valve body disposed below frost line, and a stand pipe interconnecting the two. A flow tube is mounted inside the stand pipe. The upper end of the flow tube is connected to a hydrant opening and closing actuator which reciprocates the flow tube. The lower end of the flow tube carries an ejector assembly incorporating a venturi. In its lower position the ejector engages a seat to close off an inlet line. When the hydrant is shut off, water in the upper portion of the hydrant drains to the valve body and lower portion of the stand pipe below frost line. On subsequent opening of the hydrant, this water is ejected through the venturi. The hydrant also includes a float and check valve assembly to prevent filling of the stand pipe in the event the discharge line is blocked while the hydrant is open. A modified unit in which the hydrant mechanism is embodied in a drinking fountain is also disclosed.

9 Claims, 8 Drawing Figures

SANITARY YARD HYDRANT

BACKGROUND OF THE INVENTION

This invention relates to hydrant constructions and is particularly directed to a nonfreezing, sanitary hydrant.

Many hydrants of different types are in use in outdoor areas, such as farms, parks, roadside rests, recreational areas, and the like. One requisite of many of these hydrants is that they be of a nonfreezing type so that they may be freely operated in all types of weather, including subfreezing temperatures. In order to provide such a nonfreezing hydrant, all water in the hydrant structure above the frost line must be drained subsequent to each use of the hydrant. Originally this drainage was accomplished by providing a suitable opening at the lower end of the hydrant which led to a porous filling in the ground surrounding the hydrant. While such a hydrant construction does avoid the freezing problem, it introduces another, equally serious difficulty. Specifically, under certain circumstances, a siphonage action can be created whereby ground water is siphoned from the surrounding ground area back into the water line contaminating the water supply.

In the past there have been proposals to solve such difficulties by providing hydrants which are both frostproof and sanitary, i.e., hydrants which contain their own reservoir in which water drained from the upper part of the hydrant is stored subsequent to each use. Typical patents showing constructions of this type are Stephenson U.S. Pat. No. 49,801; Normal U.S. Pat. No. 2,017,767; Hobbs et al U.S. Pat. No. 2,675,825; Boosey U.S. Pat. No. 2,598,968; and Schmid et al U.S. Pat. No. 2,605,781.

Those sanitary hydrant constructions which have proven sufficiently practical to be commercialized have still been subject to serious disadvantages. In the first place, such constructions have been quite expensive. Moreover, they have been relatively bulky and difficult to service.

SUMMARY OF THE INVENTION

The principal object of the present invention is to provide a new and improved hydrant construction which is non-freezing and nonpolluting and which, at the same time, is economical to produce, compact in size and easy to service.

More particularly, the present hydrant construction includes a stand pipe which extends from an aboveground hydrant head to a point below the frost line. This stand pipe surrounds a flow pipe with a space between the two providing a below-frost reservoir into which fluid from the flow tube can be drained subsequent to each use of the hydrant. The remaining fluid drained from the flow tube and hydrant head is stored in a main valve body secured to the lower end of the stand pipe. Consequently, the present hydrant construction eliminates the need for a large tank of the type previously utilized in many sanitary hydrant constructions.

The hydrant is provided with means for efficiently ejecting this accumulated water each time the hydrant is opened. In accordance with the present invention, this stored water is rapidly ejected by means of a movable venturi through which the main water stream flows when the valve is opened. This venturi is part of an ejector assembly which is shifted by actuation of the hydrant on-off control member between a first, or off, position and a second, or on, position.

The ejector assembly also includes fluid-controlling elements which cooperate with stationary portions of the valve body. These elements seal off the water inlet line when the ejector is in the off position while permitting the flow tube to drain into the valve body and reservoir portion of the stand pipe. When the ejector is shifted to its "on" position, these flow control elements establish a main fluid-stream path through the venturi and at the same time provide an injection flow path for the stored water so that it is drawn into the venturi stream and ejected from the hydrant.

This movable venturi construction is extremely simple and yet is highly efficient so that all of the water stored in the hydrant is rapidly ejected, e.g., in a few seconds, which is a period far shorter than a normal open time of the hydrant.

The present invention is further predicated in part upon the concept of utilizing a vertically-reciprocable flow tube as an actuating member. This construction eliminates the need for providing a separate flow tube and actuating member. More particularly, in accordance with the principles of the present invention, the flow tube extends into the valve body and supports the ejector member at its lower end. The flow tube is raised to shift the ejector assembly and its venturi to the "on" or flow position and is lowered to shift the ejector assembly to its "off" position.

It is still a further object of the present invention to provide a hydrant of simple construction which nevertheless provides maximum protection against possible mishaps during operation, such as kinking of a hose connected to the hydrant head.

More particularly, in accordance with the present invention, the valve body is provided with two chambers, an upper and lower chamber connected through a float and check valve assembly. The transverse, or injection, inlet to the venturi communicates with the lower chamber, while the stand pipe reservoir communicates with the upper chamber. The valve assembly includes a float valve disposed in the upper chamber. This float valve closes whenever all of the stored water from the upper chamber is evacuated to prevent aspiration of air through the venturi. The assembly further includes a check valve in the lower chamber. This check valve prevents back flow of water into the upper chamber and reservoir in the event that a hose, or the like, connected to the hydrant is blocked while the hydrant is turned on.

It is yet another object of the present invention to provide a hydrant which is simple to service and can readily be serviced from above ground without any need for digging. In accordance with the principles of the present invention, this object is achieved in part by providing a hydrant head construction which permits the flow tube and ejector assembly to be pulled upwardly and completely withdrawn from the hydrant for servicing. Additionally, the float and check valve assembly is threadably mounted in the main valve body with its upper end accessible through a vertical access tube. This float and check valve assembly can be unthreaded and withdrawn from the main valve body by means of an elongated tool inserted through the access tube. Thus, all of the working parts of the hydrant can readily be removed and serviced from above ground.

It is a further object of the present invention to provide a hydrant mechanism which is readily adaptable for use with other devices, such as drinking fountains, having the same desiderata, i.e., nonfreezing and nonpolluting characteristics, as yard hydrants.

The present invention further contemplates the incorporation into the hydrant mechanism of means for decreasing the operating force required on the drinking fountain handle. In accordance with the present invention, this advantage is obtained by providing an ejection construction including an area exposed to the inlet water pressure when the fountain is turned off. Thus, a bias force tending to raise the ejector assembly and flow tube is created which assists the operator at the time the fountain-operating handle is initially shifted toward its on position.

These and other objects and advantages of the present invention will be more readily apparent from the following detailed description of the preferred embodiments of the invention as shown in the drawings.

DESCRIPTION OF PREFERRED EMBODIMENT AND MODIFICATIONS

Figure 1:
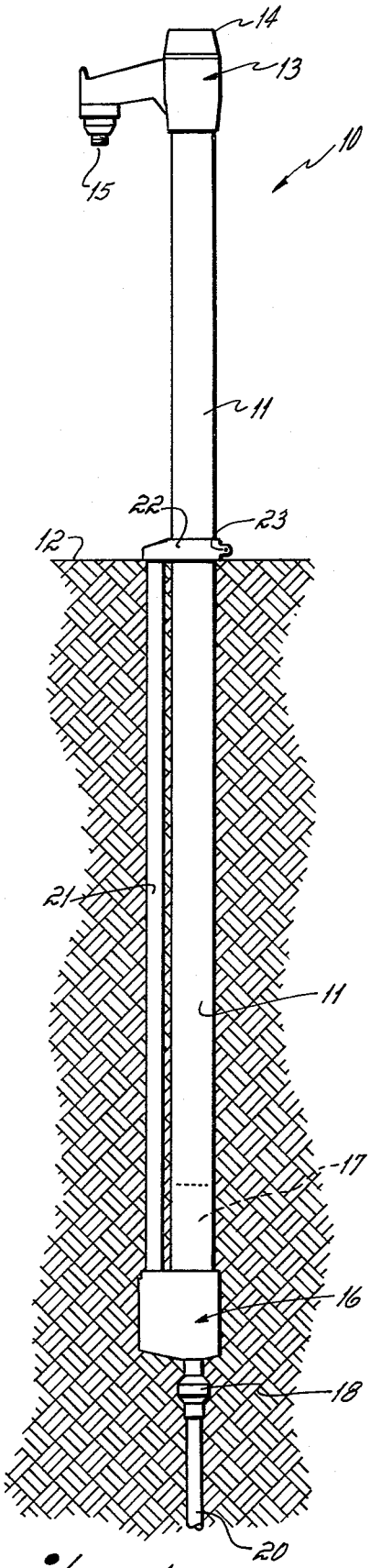
FIG. 1 is an elevational view of a sanitary hydrant constructed in accordance with the principles of the present invention.

One preferred embodiment of hydrant 10 constructed in accordance with the principles of the present invention is shown in FIG. 1. As there shown, the hydrant comprises a vertical, rigid stand pipe 11 preferably formed of a noncorrosive material such as stainless steel, galvanized steel or copper, which extends a suitable distance, for example, 2 feet, above ground level 12 and carries at its upper end a hydrant head 13 and a shutoff knob, or handle, 14. As is explained in detail below, hydrant head 13 includes a discharge outlet 15 which is preferably fitted with a coupling for receiving the end of a hose, or the like.

The lower end of stand pipe 11 extends for a substantial distance, e.g., from 2 to 6 feet, below ground, depending upon the depth of the frost line of the particular locality in which the hydrant is to be installed. More particularly, the length of the stand pipe below ground should be sufficient so that both a main valve body 16 mounted upon the lower end of the stand pipe 11 and a reservoir portion 17 at the lower end of the stand pipe are disposed beneath the frost line. The lower end of valve body 16 is provided with a coupling 18 adapted for attachment to the end of a water main, or supply line, 20. An access tube 21 extends from an opening in the main valve body 16 upwardly to a point just above ground level. The upper end of this access tube is covered by a shroud 22 having two spaced arms which are clamped about stand pipe 11 as by means of a draw bolt 23. It is to be understood that shroud 22 can be raised by loosening bolt 23 to permit upward withdrawal through the access tube of a float and check valve assembly 24 (FIG. 2) which is threadably inserted in an opening in valve body 16.

Figure 5:
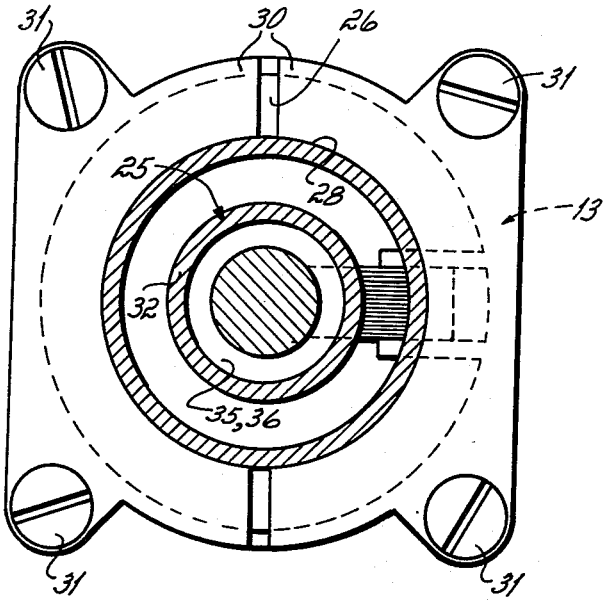
FIG. 5 is a cross-sectional view taken along line 5—5 of FIG. 2.

The remaining components of the hydrant are best shown in FIGS. 2–6. More particularly, as there shown, knob 14 is threadably mounted upon a spindle member 25. Spindle member 25 includes a lower peripheral rim 26 which rotates within a circular opening in head 13. Rim 26 carries an O-ring 27 which provides a fluid-tight seal between the spindle and head. A peripheral groove 28 is formed in the spindle above rim 26 for engagement with split retaining shoes 30. These retaining shoes are secured to head 13 as by means of bolts 31 located outwardly of the periphery of knob 14 (FIG. 5).

Spindle 25 further includes an upstanding cylindrical portion 32 which is threaded about its periphery for cooperative engagement with a depending threaded internal flange 33 of handle 14. It is to be understood that the handle is threaded downwardly over portion 13 until internal flange 33 abuts gasket 34, frictionally locking the handle to the spindle member.

The inner wall of cylindrical member 32 is provided with a female acme thread 35 which engages a corresponding male thread 36 formed on the upper end of a spool member 37. As a result of this threaded connection, when knob 14 is rotated in one direction, spool 37 is elevated, and when knob 14 is rotated in the opposite direction, spool 37 is lowered. It is to be understood that knob 14 and spindle 25 do not rise or fall when rotated.

Spindle 37 carries a stop shoulder 38 which is adapted to abut the lower portion of spindle 25 to limit upward movement of the spool. The lower end of the spool carries a generally cylindrical plug portion 40 having an O-ring 41 disposed in a groove adjacent to the lower end thereof. The interior of plug portion 40 is hollow and receives the upper end of a flow tube 42 which is soldered or otherwise permanently secured to the spool. Plug portion 40 also is provided with a cross bore 43 in fluid communication with the interior of flow tube 42. It is to be understood that when the spool 37 is in its elevated position, cross bore 43 is elevated above cylindrical wall 44 and is disposed centrally of discharge conduit 45 of the head. The conduit is connected to discharge opening 15 through an outlet vacuum breaker (not shown).

The construction of the vacuum breaker constitutes no part of the present invention and many suitable forms are well known to those skilled in the art. One preferred form of such vacuum breaker is sold by Sloan Company and is designated as "V-188A Vacuum Breaker." The function of this vacuum breaker is to prevent backsyphonage due to the creation of a vacuum in the event that a hose is attached to outlet opening 15 and its end is immersed.

It is to be understood that when spindle 37 is elevated to a position in which shoulder 38 engages the lower portion of spindle 25, O-ring 41 is disposed in sealing engagement with depending wall 44 so that water flowing from cross core 43 flows outwardly through discharge opening 15 and is prevented from flowing downwardly into stand pipe 11.

Flow tube 42, preferably formed of stainless steel or other noncorrosive material, extends downwardly through stand pipe 11. Flow tube 42 is appreciably smaller in diameter than the stand pipe so that an appreciable annular space exists between the outer wall of flow pipe 42 and the inner wall of stand pipe 11. For example, in one preferred embodiment, the outer diameter of the flow tube is 0.840 inch, while the inner diameter of the stand pipe is approximately 1.61 inches.

Figure 2:
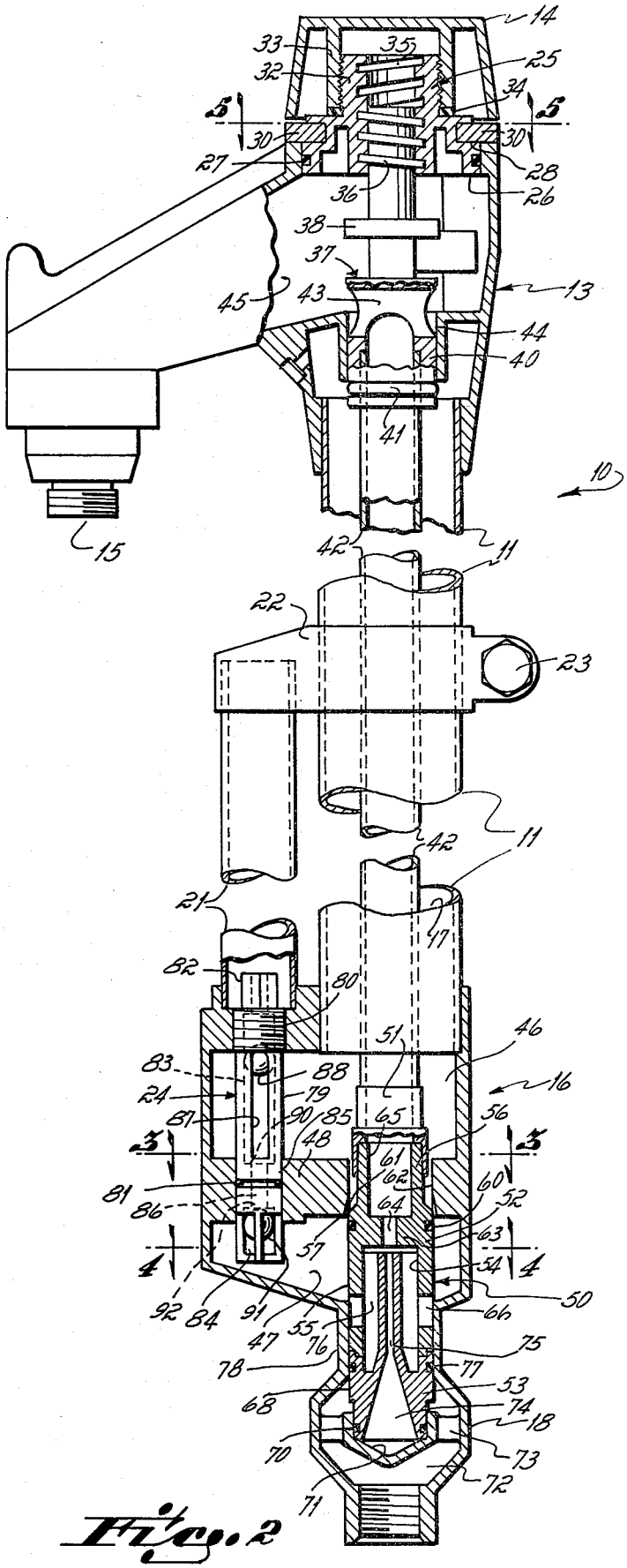
FIG. 2 is a partial, vertical, cross-sectional view of the sanitary hydrant of FIG. 1 with the stand pipe flow tube and access tube being partially broken.
Figure 3:
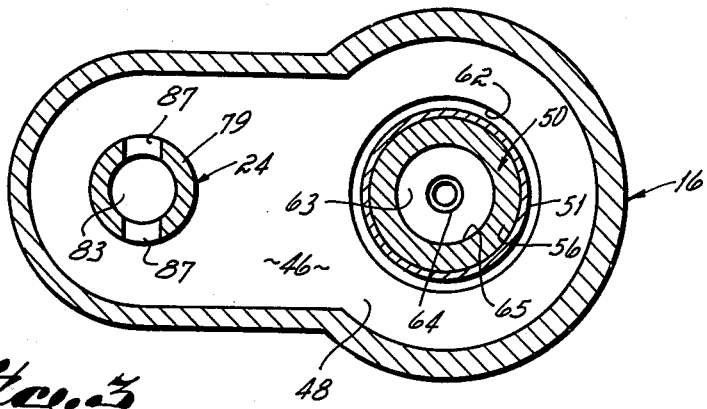
FIG. 3 is a cross-sectional view taken along line 3—3 of FIG. 2.
Figure 4:
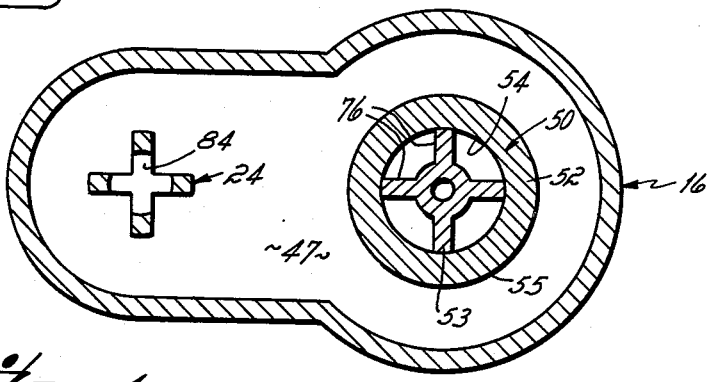
FIG. 4 is a cross-sectional view taken along line 4—4 of FIG. 2.

As shown in FIG. 2, the lower end of the flow tube 42 extends downwardly below the lower end of stand pipe 11 and into the upper chamber 46 of main valve body 16. This main valve body is provided with an upper opening for receiving the lower end of stand pipe 11, the stand pipe beig soldered or otherwise permanently joined in fluid-tight relationship to the valve body.

Valve body 16 includes an upper chamber 46 and a lower chamber 47 which are separated from one another by a transverse wall 48. Wall 48 is provided with two cylindrical openings, one for receiving float and check valve assembly 24 and one for receiving ejector assembly 50.

The ejector assembly 50 is carried by a collar 51, the collar being soldered or otherwise mounted upon the lower end of flow tube 42. Alternatively, flow tube 42 can be soldered directly to the ejector assembly and collar 51 omitted. The ejector assembly includes an upper section 52 and a lower section 53 which are preferably formed of molded plastic, such as Noryl 731-S, or the like. The two sections are joined together by means of any suitable adhesive applied.

Figure 6:
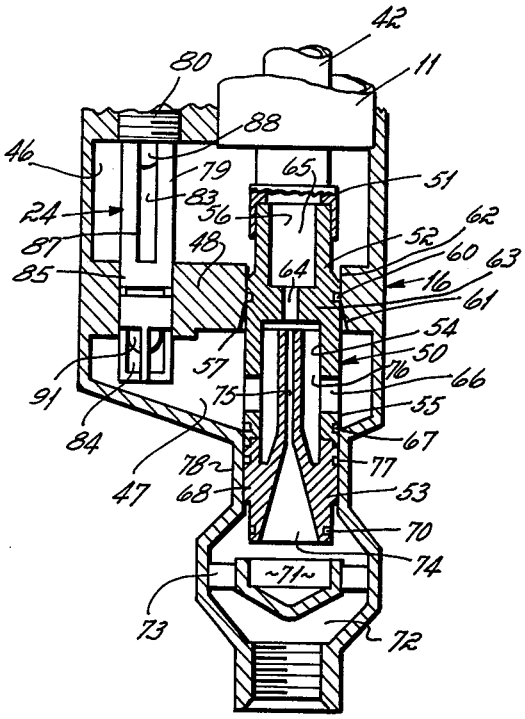
FIG. 6 is a partial sectional view of the main valve body showing the ejector assembly in an open or raised position.

Upper section 52 is of generally cylindrical outline configuration, including a main section 55 and an upper neck section 56 of slightly reduced diameter and which is joined to the main section by means of a tapered shoulder 57. The main section 55 carries an O-ring 60 mounted in a peripheral groove. When the ejector is in its lowermost, or sealing, position shown in FIG. 2, shoulder 57 and O-ring 60 are spaced from a relieved portion 61 of the large opening 62 formed in transverse wall 48 to provide a fluid passageway surrounding the ejector assembly between the lower and upper chambers of the valve body. When, however, the ejector assembly is raised to its flow position as shown in FIG. 6, O-ring 60 provides a fluid-tight seal between the periphery of the ejector assembly and transverse wall 48.

The upper section 52 of the ejector assembly also includes an internal cross wall 63 having a small fluid bore 64 formed therethrough. This bore communicates with a large bore 65 formed in neck portion 56, bore 65 being of substantially the same diameter as the internal diameter of flow tube 42. The lowermost portion of ejector section 55 is provided with an enlarged axial bore 54 which extends from cross wall 63 to the lowermost end of the ejector section 55. A diametral, transverse bore 66 is formed in the wall of ejector section 55.

The lower section of the ejector assembly includes a generally cylindrical portion 68 which is provided with a groove carrying O-ring 70 effective to provide a seal with the inner walls of a stationary seat 71. Seat 71 is disposed centrally of an inlet chamber 72 formed at the extreme lower end of main valve body 16, the seat being carried by a plurality of radial webs 73 which support the inverted cup-like seat from the inner walls of the housing.

Lower section 53 of the ejector is provided with a venturi conduit including an inwardly converging inlet section 74 and a constricted conduit portion 75 of a diameter preferably smaller than the diameter of bore 64. Constricted conduit 75 is aligned with bore 64, but is spaced a slight distance therefrom. A plurality of radial webs 76 extend between the outer walls of conduit 75 and the inner walls of the upper ejector section 52. The upper edges of these webs are spaced from cross wall 63. It is to be noted that when the ejector is in its lowermost or sealed position as shown in FIG. 2, O-ring 77 carried by section 53 is compressed into fluid-tight engagement with a necked down portion 78 formed in the valve body 16 intermediate inlet chamber 72 and lower chamber 47. When the ejector member is raised to its flow position as shown in FIG. 2, this O-ring remains in contact with the neck portion to retain a seal between the neck portion and the periphery of the ejector assembly. However, when the ejector is in this raised position, the lower ejector section is raised above seat 71 so that a fluid path is opened from the inlet coupling to the outlet fitting 15 of the hydrant.

More particularly, the fluid path extends from the inlet coupling 18 through inlet chamber 72, converging conduit section 74 of the ejector, constriction conduit section 75 of the ejector, bores 64 and 65 of the ejector, flow tube 42, the interior of spindle 37, cross bore 43, conduit 45, the vacuum breaker (not shown), and discharge coupling 15.

The final component of the hydrant is float and check valve assembly 24. This assembly is preferably formed of a molded plastic, such as Noryl 731-S. This assembly 24 includes a generally cylindrical housing 79 having a threaded upper shoulder 80 in engagement with an opening in the upper wall of the main valve body 16. The housing 79 extends downwardly through transverse wall 48 of the valve body and carries an O-ring 81 effective to provide a watertight seal between the transverse wall and body 79. The valve body further includes an upper projection 82 adapted to be engaged by a socket tool, or wrench, to permit removal of the assembly.

Housing 79 includes two internal ball-receiving cavities, an upper cavity 83 and a lower cavity 84, separated by a center section 85. An internal bore 86 provides fluid communication between the two cavities.

Upper cavity 83 is provided with transverse openings 87 which open into upper chamber 46 of the valve body, while lower cavity 84 is similarly provided with transverse openings which open into lower chamber 47. The upper cavity 83 is provided with a seat 90 adjacent to its lower end for cooperation with an entrapped float ball 88. Ball 88 is preferably made of a plastic material, such as polypropylene, having a specific gravity less than one. Consequently, so long as there is water in upper chamber 46 of the valve body, ball 88 is spaced from seat 90. However, when water is drained from chamber 46, ball 88 engages seat 90 to prevent air from being drawn downwardly into chamber 47. A similar ball 91 is mounted in lower chamber 84. Ball 91 is adapted to seat against seat 92 to function as a check valve.

The function of this check valve is to prevent the stand pipe from becoming completely filled in the event that a hose, or the like, connected to outlet fitting 15 is blocked while the hydrant is turned on. As shown in FIG. 6, if this condition were to occur, water from the main 20 would flow from coupling 18 into inlet cavity 72 upwardly through the inlet section 74 and constricted bore 75 of the ejector assembly. Further upward flow would then be blocked and would flow outwardly through transverse ports 66 into lower cavity 47 of the valve body. In the absence of the check valve, this water would then flow upwardly through the check valve body into upper cavity 46 of the valve body and, hence, would fill the stand pipe. However, this is prevented by check ball 91 which floats and rises with the water level in lower chamber 47 so that once this chamber is substantially full, the ball seats against seat 92 and prevents additional flow into upper chamber 46.

Operation of the present hydrant can best be understood from a consideration of FIGS. 2 and 6. FIG. 2 illustrates the condition of the hydrant in its off position. As there shown, knob 14 has been rotated to shift spool 37, flow tube 42 and the ejector assembly 50 downwardly. The lower end of the ejector assembly provides a seal against the in-flow of water from the main 20. More particularly, flow around the periphery of the ejector assembly is prevented by the sealing engagement of ring 77 against neck portion 78 of the valve body, while flow upwardly through the ejector assembly is prevented by the sealing engagement of sealing ring 70 with seat 71.

Normally, with the hydrant in this condition, lower chamber 47, upper chamber 46, and the lower portion of flow tube 42 and reservoir portion of stand pipe 11 (below the freeze line) will be filled with water drained from the upper portion of the flow tube and hydrant head during the preceding cycle. Back flow of water into the main is prevented by the sealing engagement of the ejector member with seat 71 and neck 78 described above.

The hydrant is turned on by rotating knob 14 to raise spindle 37, flow tube 42 and the ejector assembly 50. Upward movement of the spool member is limited by the engagement of shoulder 38 with the lower portion of the spindle 32.

As the ejector assembly is raised to its open position illustrated in FIG. 6, the lower portion of the ejector assembly is withdrawn from seat 71, although the periphery of the ejector assembly remains in sealed contact with neck 78. Water thus flows inwardly from line 20 through lower inlet cavity 72, through converging section 74 and constricted bore 75 of the ejector assembly. This water continues to flow upwardly through bores 64 and 65 of the ejector assembly from which it enters flow tube 42. Water flows upwardly through this tube, through the interior of spool 37, and through cross bore 43 into discharge conduit 45 from which it flows outwardly through the vacuum breaker and discharge coupling 15.

At the same time, the water previously accumulated in the lower portion of stand pipe 11, upper chamber 46 and lower chamber 47 of the main body is ejected outwardly with the main water stream. More particularly, the water flows downwardly from the bottom portion of tube 11 into chamber 46 through the upper and lower cavities of the float and check valve assembly into lower chamber 47. From this chamber fluid flows through cross bore 66 of the ejector assembly into the space between the end of constricted bore 75 and bore 64. Due to the venturi action of the main fluid stream, the pressure in this area is greatly reduced so that the previously stored water is drawn into the main stream and flows upwardly through the flow tube. We have determined that this embodiment provides extremely sufficient aspiration and that all of the water accumulated in the hydrant is completely evacuated within a few seconds, far less than the normal period of use of the hydrant.

When it is again desired to turn off the hydrant, knob 14 is turned in the opposite direction to lower spindle 37, flow tube 42 and the ejector assembly. This latter assembly is returned to its inlet sealing position shown in FIG. 2. When the ejector assembly seats against seat 71, further in-flow of water from the inlet 20 is stopped. However, at this moment, water is present in the entire flow tube 42, the interior of spindle 37 and chamber 45. This water now drains downwardly through tube 42 and bores 65, 64 and 66, into lower chamber 47. Water flows from chamber 47 upwardly through the clearance space 61 provided between the periphery of the ejector assembly and bore 62 into upper chamber 46 and into the lower annular space of the stand pipe.

The dimensions of the stand pipe, flow tube and valve body cavities are related so that the water drained from the upper portion of the flow tube fills the stand pipe to an elevation which is below the frost line. Thus, after the present hydrant has been turned off, the upper portion of the hydrant is completely drained and all water remaining in the unit is sufficiently far below ground that it cannot freeze. Consequently, the present hydrant can be rapidly turned on and off even in the coldest weather without any danger of freezing.

All maintenance work on the hydrant can be carried out from above ground. More particularly, the working parts of the hydrant can be readily serviced by removing bolts 31 and sliding retaining shoes 30 outwardly. Thereafter, knob 14 can be lifted and will carry with it spindle 32, spool 37, flow tube 42 and ejector assembly 50. When these parts have been serviced, the ejector assembly and flow tube 42 are again lowered through the stand pipe 11 and retaining shoes 30 are replaced to again secure the parts in assembled relationship.

In the event that the flow and check valve needs repair, this can be readily accomplished by loosening bolt 23 to remove shroud 22. A suitable tool is then lowered through tube 21 into engagement with the upper lug 82 on the check and float ball valve body 79. This body is then rotated to disengage it from the main valve body 16. The float and check valve assembly is then raised through access tube 21, is serviced and repositioned by lowering it through the access tube.

Figure 7:
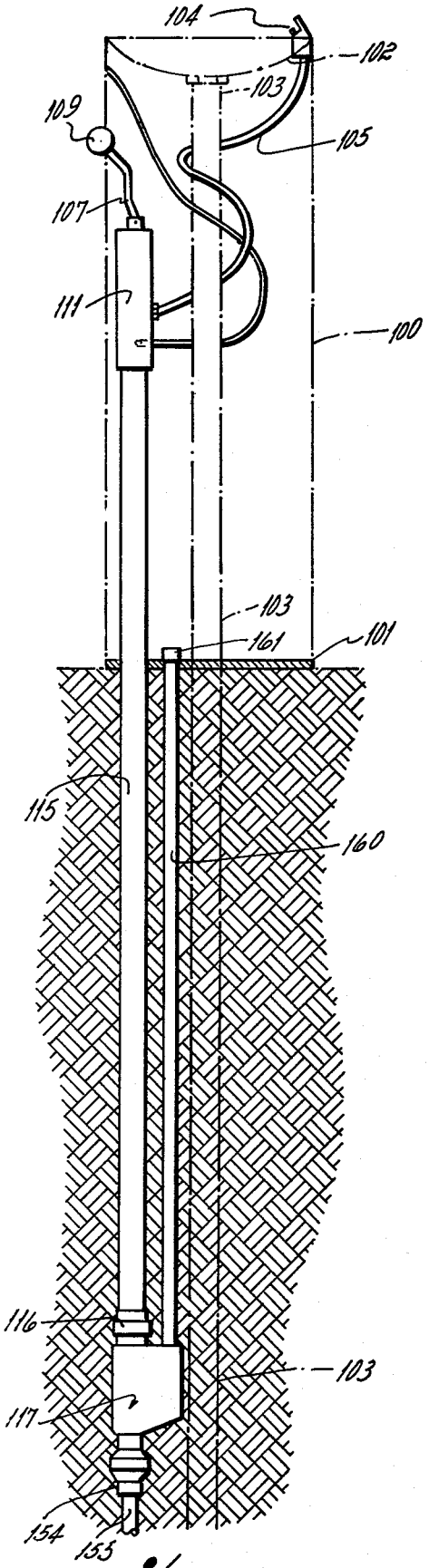
FIG. 7 is a vertical view of a drinking fountain embodying the principles of the present invention.
Figure 8:
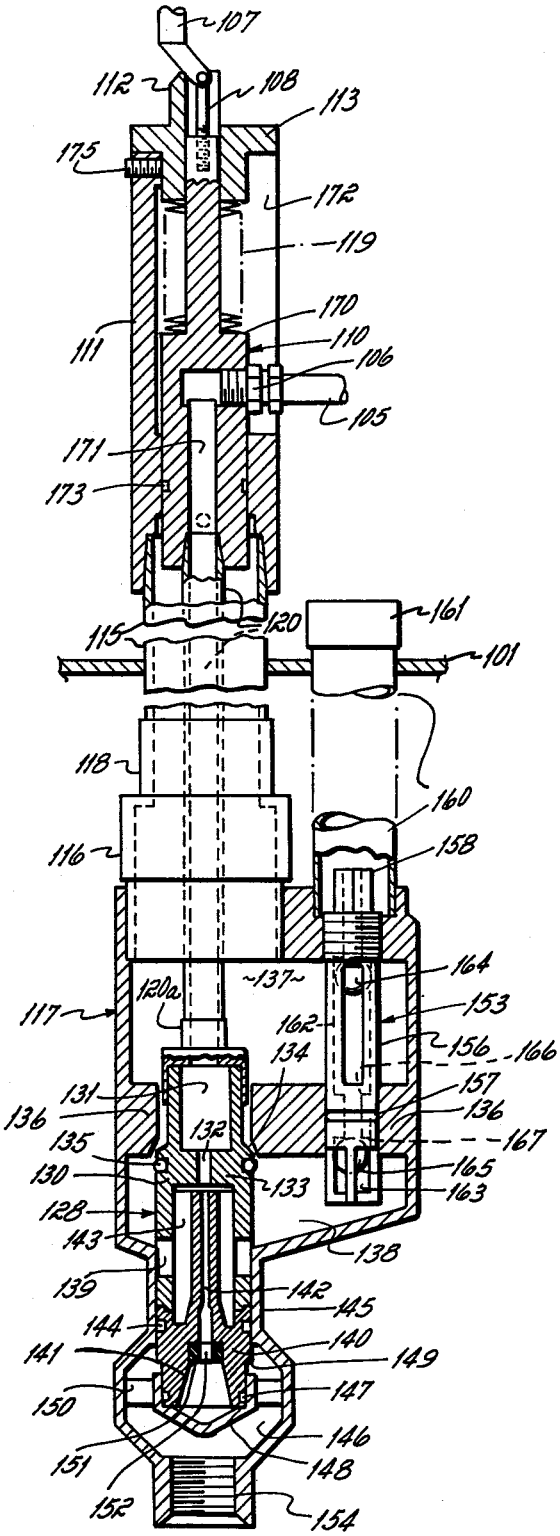
FIG. 8 is a vertical, cross-sectional view, partially broken, of the lower portion of the drinking fountain unit shown in FIG. 7.

A modified construction in the form of a drinking fountain embodying the present invention is shown in FIGS. 7 and 8. As there shown, the drinking fountain is of the pedestal type including a pedestal housing 100 mounted upon a base plate 101. It is to be understood that the base plate may be bolted or otherwise secured to a slab (not shown).

Housing 100 supports a bowl 102 connected to a drain line 103 in a conventional manner. A bubbler head 104 of any conventional type is mounted above the bowl and is connected by means of a flexible tube 105 to outlet opening 106 of the hydrant unit. The water fountain also includes an actuating handle 107, which can be depressed to turn the fountain on, pivotally mounted upon an upstanding bracket or eye bolt member 108 secured to a cylindrical spool member 110. This cylindrical member is slidably mounted in an upper housing, or head, 111 secured to the upper end of a downwardly-extending stand pipe 115 formed of a suitable noncorrosive material.

Handle 107 is preferably of an angular configuration and extends through an opening in pedestal housing 100 so that it can be manipulated from outside the pedestal housing. An upstanding stationary cam member 112 is mounted upon a cover 113 of upper housing 111. This cam is engaged by the handle so that downward movement on the end 109 of the handle causes the bracket 108 to be raised. This in turn causes the spool 110 to be elevated against the force of a stack of bellow elements 119 compressed between a shoulder 170 on spool 110 and the cover member 113. It is to be understood that elements 119 normally spring-urge the unit to a closed or nonflow condition.

Spool member 110 is soldered or otherwise secured to the upper end of a flow tube 120 which extends downwardly within the stand pipe. Tube 120 communicates with a bore 171 in spool 110 and this bore in turn communicates with outlet fitting 106 carried by spool 110. Head member 111 is provided with a vertical slot 172 which permits coupling member 106 and tube 105 to be shifted vertically with spool 110.

As in the preferred embodiment, stand pipe 115 extends downwardly through base plate 101 into the ground an appreciable distance below the frost line. The lower end of the stand pipe is interconnected to an upstanding nipple 116 soldered or otherwise secured to main valve housing 117. The joint between stand pipe 115 and nipple 116 is sealed by means of a cap 118 which is soldered or otherwise secured in place.

Flow tube 120 extends downwardly inside stand pipe 115 as in the preferred embodiment. As explained above, the upper end of flow tube 120 is soldered or otherwise secured to an internal bore in spool member 110. A fluid-tight seal is provided between the spool and head member 111 by means of an O-ring 173 fitted in a peripheral groove in the spool member and in sliding engagement with the inner wall of the head member.

The lower end of flow tube 120 is connected to an ejector assembly 128. A cap **120*a* surrounds the lower end of tube 120** and the upper end of the ejector assembly to provide a sealed connection between these members.

Ejector assembly 128 is generally similar to the ejector assembly of the preferred embodiment. More particularly, the ejector assembly includes an upper member 130 having an interconnecting large bore 131 and small bore 132, the latter being formed in an internal cross wall 133. The peripheral wall of the upper section 130 includes a tapered shoulder 134 and a groove housing an O-ring 135. The shoulder and O-ring are spaced from the adjacent cross wall 136 of the main valve body 117 when the ejector is in its lowermost or closed position shown in FIG. 8. Consequently, a flow space is provided surrounding the ejector between upper cavity 137 of the main valve body and lower cavity 138 of that valve body. The side wall of upper ejector section 130 is provided with a diametral bore 139. When the ejector is in its raised or open position, this bore opens into lower cavity 138 of the main valve body.

The ejector assembly also includes a lower section 140 having a converging conduit portion 141 and a constricted conduit portion 142 in alignment with small bore 132 spaced from the end thereof. A plurality of radial webs 143 are formed integral with the lower ejector assembly. These webs terminate in spaced relationship to cross wall 133.

The lower ejector assembly also is provided with a peripheral groove housing an O-ring 144 in sealing engagement with a neck portion 145 formed on the main body housing intermediate lower cavity 138 and an inlet cavity 146. The ejector assembly carries a second, peripherally-mounted O-ring 147 adapted to be forced into sealing engagement with an inverted cup-like seat 148 disposed in inlet cavity 146. Seat 148 is supported by means of radial webs 150 secured to the inner surface of the wall surrounding inlet cavity 146. Again, it is to be understood that when the ejector assembly is elevated to its open position, the lower end of the ejector assembly will be disposed above and spaced from seat 148, while O-ring 144 will remain in sealing engagement with neck portion 145.

The lower section of the ejector assembly carries at the upper end of the converging passage 141 a flow control valve member 151. The construction of this flow control member constitutes no part of the present invention. However, those skilled in the art are readily familiar with various forms of suitable flow control valves which constitute a deformable diaphragm having a central opening 152. When pressure on the inlet side of the ejector increases, the flow control member is deformed to cause a corresponding decrease in the size of flow control opening 152 to thereby maintain a preselected rate of flow through the device. One suitable form of flow control member is sold by the Dole Company.

As shown in FIG. 8, lower ejector section 140 is provided with a downwardly facing radial shoulder 149 exposed to the inlet fluid pressure. Thus, the inlet line pressure acting upon this shoulder provides a bias force which assists in the initial upward movement of the ejector assembly when the handle 107 is first depressed. This is particularly advantageous in a fountain in which it is desired to minimize the amount of force required to operate the unit.

Main valve body 117 is substantially identical with the valve body of the preferred embodiment. It includes upper chamber 137 and lower chamber 138 separated by a transverse wall 136. This wall is provided with one opening for receiving the ejector assembly and a second opening for receiving a float and check valve assembly 153. The valve body also includes a neck portion 145 separating lower chamber 138 from an inlet chamber 146. The inlet chamber communicates with a coupling 54 adapted to be connected to an inlet line or water main 155.

Housing 117 is also provided with a bore in its top wall for threadably receiving check and ball valve assembly 153. This assembly includes a housing 156 which extends downwardly through upper chamber 137 and through a bore in cross wall 136 into lower chamber 138. Housing 156 carries an O-ring 157 in sealing engagement with cross wall 136.

An upstanding projection 158 is formed on the float and check valve assembly permitting the assembly to be rotated by means of an elongated tool inserted through an access tube 160. This tube is secured to the upper wall of housing 117 and extends upwardly through an opening in base plate 101. The upper end of access tube 160 is closed as by means of a cap 161.

The construction and function of the float and check valve assembly 113 is the same as the float and check valve assembly of the preferred embodiment. More particularly, the assembly includes upper and lower cavities 162 and 163 housing balls 164 and 165, respectively. Upper ball 164 is adapted to seat upon a seat 166 formed at the lower end of the cavity 162 so that the ball is effective to function as a float valve. Similarly, ball 165 is adapted to seat against a seat 167 formed adjacent the upper portion of cavity 163 so that ball 165 is effective to function as a check valve.

The general operation of the drinking fountain embodiment of FIGS. 7 and 8 is substantially the same as that of the preferred embodiment. More particularly, when the unit is in the "off" position shown in FIG. 8, the lower end of the ejector assembly seals off inlet line 155. Water from the previous cycle of operation is stored in lower cavity 138, upper cavity 137, the lower portion of flow tube 120 and a reservoir portion of stand pipe 115 below the frost line.

When the fountain is turned on by depressing operating handle 107, spool member 110 is raised which in turn raises flow tube 120 and ejector assembly 128. The ejector assembly is thus removed from engagement with seat 148 so that water flows upwardly from main 155 through inlet chamber 146, the central aperture in flow control member 151, the converging and constricted bores of the lower ejector member, the large and small bores 131 and 132 of the upper ejector section, flow tube 120, spool 110 through discharge opening 106 into tube 105 from which the water flows to bubbler 104.

At the same time, water which has previously accumulated in stand pipe 115 and chambers 137 and 138 is drawn upwardly by the venturi action of the ejector assembly. More particularly, this water flows downwardly through body 156 of the float-check valve assembly into lower cavity 138. From this cavity water flows through cross bore 139 of the ejector assembly into the low pressure space between constricted bore 142 and small bore 132. The water is drawn at this point into the stream of water flowing upwardly toward flow tube 120. Again, all of the water accumulated in the stand pipe is evacuated in a matter of a few seconds, which is less than the normal open period in which a drinking fountain is turned on.

When the fountain is turned off by releasing handle 107, spool 110 is spring-urged downwardly by bellows members 119. Spool 110 in turn forces flow tube 120 and ejector assembly 128 downwardly. Thus, the ejector assembly is returned to its "off" position shown in FIG. 8. Further flow from main 155 is cut off. Thereafter, water drains downwardly from the upper portion of flow pipe 120 into the upper and lower chambers 137 and 138 of the valve body and the lower reservoir portion (below frost line) of stand pipe 115. This water is prevented from being returned to the main by the seal between the ejector assembly 128 and seat 148.

As in the preferred embodiment, the hydrant mechanism can be fully serviced from above ground. More particularly, the check and ball valve assembly can be removed for servicing by removing cap 161 and disengaging the valve body from the housing by means of an elongated tool inserted through access tube 160. Thereafter, the float and ball valve asembly can be withdrawn upwardly through the access tube and can subsequently be reinstalled through the tube.

The remaining working parts of the hydrant mechanism can be withdrawn by loosening a retaining screw 175 which holds cover 113 in place. The cover is then removed and handle 107 is disconnected from bracket 108. Spool 110, flow tube 120 and the ejector assembly 128 can be lifted from the unit for servicing.

From the above disclosure of the general principles of the present invention and the preceding detailed description of two embodiments, those skilled in the art will readily comprehend various modifications to which the present invention is susceptible. Therefore, we desire to be limited only by the scope of the following claims.

Having described our invention, we claim:

1. A nonfreezing, sanitary hydrant mechanism adapted to be connected to an inlet line disposed below the frost line of the earth and to discharge water through a discharge opening, said hydrant comprising:

a head;

a main valve body adapted to be disposed below the frost line, and having an upper and a lower chamber formed therein;

a transverse wall dividing said upper and lower chambers and having two openings formed therein;

a stand pipe extending upwardly from said main valve body and interconnecting the head and said upper chamber of the main valve body;

means for connecting the valve body to the inlet line;

a flow tube disposed within said stand pipe and being in fluid communication with said discharge opening through said head;

the lower portions of said flow tube and stand pipe and the interior of said valve body chambers providing a receptacle for storing below frost line water drained from said head and the upper portion of said flow tube;

an ejector member passing through one opening in said transverse wall and including a peripheral wall, a venturi tube mounted within said peripheral wall in spaced relationship thereto, said peripheral wall having openings extending therethrough;

said ejector member being in fluid communication with said flow tube;

said ejector member including flow control means;

said ejector member being movable between first and second positions;

said ejector member in said first position causing said flow control means to seal off said inlet line;

said transverse openings in said ejector wall being disposed in fluid communication with said lower chamber, whereby fluid is free to drain from said head and flow tube into said lower chamber and into the lower portion of said stand pipe in the first position;

said ejector member in said second position causing said flow control means to open said inlet line for flow through said venturi and flow tube to said discharge opening;

said ejector member being in sealed engagement with said transverse wall when said ejector member is in said second position;

said ejector member and flow tube defining a conduit structure through said upper chamber in fluid communication with said head in the second position;

said ejector member in said second position further causing said peripheral wall openings to be disposed in the lower portion of the valve body chamber to connect the interior of said valve body to said venturi, whereby water stored in the main valve body and said stand pipe is ejected from said hydrant;

float and check valve means for controlling flow through said second opening in said transverse wall;

and actuating means for selectively shifting said ejector from one of said positions to the other.

2. The hydrant mechanism of claim 1 in which said ejector member is mounted upon said flow tube and said actuating means reciprocates said flow tube.

3. The hydrant mechanism of claim 2 in which said main valve body further comprises an inlet chamber and a neck portion intermediate said inlet and lower chambers, said ejector member communicating with said lower chamber and being in sealed engagement with said neck portion;

said inlet chamber having a stationary seat formed therein;

said ejector member being in sealed engagement with said seat when said ejector member is in said first position and being spaced from said seat when said ejector member is in said second position.

4. The hydrant mechanism of claim 1 in which said valve body further includes an inlet chamber;

said main valve body having a necked portion disposed intermediate said lower chamber and said inlet chamber;

said inlet chamber having a stationary seat formed therein;

said ejector member being in sealed engagement with said necked portion, said ejector member also being in sealed engagement with said seat when said ejector member is in its first position;

said ejector member being spaced from said seat when said ejector member is in said second position;

the peripheral wall openings of said ejector being disposed in said lower chamber;

said ejector member permitting flow through the opening in said transverse wall surrounding said ejector member when said ejector member is in said first position.

5. The hydrant mechanism of claim 4 in which said float and check valve means includes a body in sealed engagement with said transverse wall, said body including two cavities, one cavity in communication with the upper chamber and one cavity in communication with the lower chamber;

a float ball in each cavity;

a seat on the lower end of said first cavity and a seat on the upper end of said second cavity, whereby said upper ball is effective to prevent injection of air into said venturi when said upper cavity is completely drained and said lower ball is effective to prevent back-filling of said stand pipe.

6. The hydrant mechanism of claim 4 in which said main valve body includes a threaded opening in the upper wall thereof, and said float and check valve means includes a body threadably received in said opening and having a portion engageable by a tool disposed above said opening, and an access tube extends from said valve body above said opening to ground level.

7. The hydrant mechanism of claim 4 in which said ejector member is mounted upon said flow tube and said actuating means reciprocates said flow tube, said head including removable closure means, said flow tube and ejector member being withdrawable from said head when said closure means are removed.

8. The hydrant mechanism of claim 1 in which said ejector member is mounted upon said flow tube, and said actuating means comprises a rotary handle, a spindle connected to said handle for rotation therewith, a spool member threadably engaging the interior of said spindle and being raised and lowered when said handle is rotated, said spool member being secured to said flow tube and having a transverse opening in fluid communication with said flow tube and a discharge opening in said head, said spool being effective to seal said head from said stand pipe when said ejector member is in said second position, but permitting flow from said head into said stand pipe when said ejector member is in said first position.

9. The hydrant mechanism of claim 8 further comprising removable shoes in engagement with a peripheral groove in said spindle member, said shoes normally restraining said spindle member against outward withdrawal, said spindle member being free for outward movement when said shoes are removed.

* * * * *